US009531143B2

(12) United States Patent
Gao et al.

(10) Patent No.: US 9,531,143 B2
(45) Date of Patent: Dec. 27, 2016

(54) RJ45 SOCKET CONNECTOR HAVING A CONDUCTIVE TERMINAL FOR PREVENTING YIELD DUE TO MISTAKEN INSERTION

(71) Applicant: FOXCONN INTERCONNECT TECHNOLOGY LIMITED, Grand Cayman (KY)

(72) Inventors: Sheng-Pin Gao, Kunshan (CN); Hai-Long Fu, Kunshan (CN)

(73) Assignee: FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 0 days.

(21) Appl. No.: 14/831,790

(22) Filed: Aug. 20, 2015

(65) Prior Publication Data

US 2016/0056595 A1 Feb. 25, 2016

(30) Foreign Application Priority Data

Aug. 20, 2014 (CN) ..... 2014 1 0408924

(51) Int. Cl.
*H01R 24/62* (2011.01)
*H01R 24/64* (2011.01)
*H01R 13/642* (2006.01)

(52) U.S. Cl.
CPC ..... *H01R 24/64* (2013.01); *H01R 13/642* (2013.01)

(58) Field of Classification Search
CPC ..... H01R 24/64; H01R 13/642
USPC ..... 439/677, 680, 676
See application file for complete search history.

(56) References Cited

U.S. PATENT DOCUMENTS 5,387,135 A * 2/1995 Shen ..... H01R 24/62 439/676
5,674,093 A * 10/1997 Vaden ..... H01R 13/6461 439/676
5,911,602 A * 6/1999 Vaden ..... H01R 13/6467 439/676
6,227,911 B1 * 5/2001 Boutros ..... H01R 13/719 439/490
6,312,293 B1 * 11/2001 Wang ..... H01R 13/6275 439/607.01

(Continued)

FOREIGN PATENT DOCUMENTS

TW 327577 U 7/2007
TW 378547 U 10/2009
WO WO2008083834 7/2008

*Primary Examiner* — Abdullah Riyami
*Assistant Examiner* — Nelson R Burgos-Guntin
(74) *Attorney, Agent, or Firm* — Wei Te Chung; Ming Chieh Chang

(57) ABSTRACT

An RJ45 socket connector includes an insulative housing having a receiving chamber; and a plurality of conductive terminals held in the insulative housing, the conductive terminal having an elastic contact section oblique upwardly and backwardly extending along an insertion direction. The elastic contact section has a first part extending oblique upwardly, a second part downwardly and backwardly bent from the first part, and a third part upwardly extending from the second part. A connecting portion between the first part and the second part is adapted to contact mating contacts of an inserted RJ45 plug, and the connecting portion is adapted to resist a lower insulative body surface of a mistakenly inserted RJ11 plug.

20 Claims, 6 Drawing Sheets

(56) References Cited

U.S. PATENT DOCUMENTS 6,334,792 B1 * 1/2002 Schmidt ..... H01R 13/743 439/557
6,458,001 B1 * 10/2002 Chen ..... H01R 13/64 439/676
6,511,348 B1 * 1/2003 Wojtacki ..... H01R 12/724 439/541.5
6,729,914 B2 * 5/2004 Jaouen ..... H01R 24/64 439/676
6,840,817 B2 * 1/2005 Chen ..... H01R 13/65807 439/620.01
6,935,900 B2 * 8/2005 Wan ..... H01R 13/64 439/676
6,957,984 B1 * 10/2005 Huang ..... H01R 13/641 439/676
7,121,898 B2 * 10/2006 Murr ..... H01R 24/64 439/676
7,172,466 B2 * 2/2007 Aekins ..... H01R 13/6474 439/676
7,481,678 B2 * 1/2009 Aekins ..... H01R 13/7033 439/620.11
7,985,101 B2 * 7/2011 Fitzpatrick ..... H01R 13/64 439/676
8,075,347 B2 * 12/2011 Hogue ..... H01R 4/2425 439/676
2004/0198099 A1 * 10/2004 Xue ..... H01R 13/64 439/676
2004/0242077 A1 * 12/2004 Chang ..... H01R 13/6658 439/676
2005/0095920 A1 * 5/2005 Aekins ..... H01R 13/6474 439/676
2005/0202697 A1 * 9/2005 Caveney ..... H05K 1/0228 439/77
2009/0029599 A1 * 1/2009 Jaouen ..... H01R 24/64 439/676
2010/0062644 A1 * 3/2010 Aekins ..... H01R 13/6625 439/620.21
2010/0227486 A1 * 9/2010 Lin ..... H01R 13/447 439/144
2011/0097935 A1 * 4/2011 Schempp ..... H01R 9/091 439/620.22
2012/0142199 A1 * 6/2012 Purkis ..... H01R 24/64 439/39
2014/0073195 A1 * 3/2014 Fransen ..... H01R 13/6467 439/676
2014/0227894 A1 * 8/2014 Schweizer ..... H01R 13/6461 439/131
2014/0248807 A1 * 9/2014 Babu ..... H01R 13/26 439/676
2014/0273570 A1 * 9/2014 Fransen ..... H01R 29/00 439/174
2014/0273638 A1 * 9/2014 Valenti ..... H01R 13/6466 439/620.22
2014/0349519 A1 * 11/2014 Gao ..... H01R 13/648 439/607.01
2015/0056824 A1 * 2/2015 Bolouri-Saransar ..... H01R 4/24 439/64
2015/0147914 A1 * 5/2015 Gao ..... H01R 12/716 439/638
2015/0340823 A1 * 11/2015 Stanislaw ..... H01R 4/242 439/404
2016/0036178 A1 * 2/2016 Riccardi ..... H01R 12/62 439/620.23
2016/0056579 A1 * 2/2016 Lindkamp ..... H01R 13/6466 439/620.21
2016/0056595 A1 * 2/2016 Gao ..... H01R 13/642 439/345
2016/0056596 A1 * 2/2016 Gao ..... H01R 24/64 439/38
2016/0064878 A1 * 3/2016 Ku ..... H01R 12/716 439/78

* cited by examiner

RJ45 SOCKET CONNECTOR HAVING A CONDUCTIVE TERMINAL FOR PREVENTING YIELD DUE TO MISTAKEN INSERTION

BACKGROUND OF THE INVENTION

1. Field of the Invention

The present invention relates to an RJ45 socket connector, especially to a structure of the conductive terminal.

2. Description of Related Arts

U.S. Pat. No. 7,121,898, issued on Oct. 17, 2006, discloses a stacking RJ45 socket connector. The stacking RJ45 socket connector includes an insulative housing and a terminal module received in the insulative housing. The terminal module includes a base and a number of conductive terminals integrated in the base. The conductive terminal has a holding portion fixed in the base, a bending portion extending from the holding portion beyond the base, and an elastic contact portion backwardly and oblique upwardly extending from the bending portion. When an RJ11 plug is inserted into the RJ45 socket connector, an insulative body of the RJ11 plug presses the elastic contact portion directly such that the conductive terminal is prone to plastic deformation, i.e., easy to yield.

An improved structure of the conductive terminal is desired.

SUMMARY OF THE INVENTION

An object of the present invention is to provide an RJ45 socket connector including an improved structure of the conductive terminal.

To achieve the above-mentioned object, an RJ45 socket connector includes an insulative housing having a receiving chamber; and a plurality of conductive terminals held in the insulative housing, the conductive terminal having an elastic contact section oblique upwardly and backwardly extending along an insertion direction. The elastic contact section has a first part extending oblique upwardly, a second part downwardly and backwardly bent from the first part, and a third part upwardly extending from the second part. A connecting portion between the first part and the second part is adapted to contact mating contacts of an inserted RJ45 plug, and the connecting portion is adapted to resist a lower insulative body surface of a mistakenly inserted RJ11 plug.

Other objects, advantages and novel features of the invention will become more apparent from the following detailed description when taken in conjunction with the accompanying drawings.

DETAILED DESCRIPTION OF THE PREFERRED EMBODIMENT

Reference will now be made in detail to the preferred embodiment of the present invention.

Figure 1:
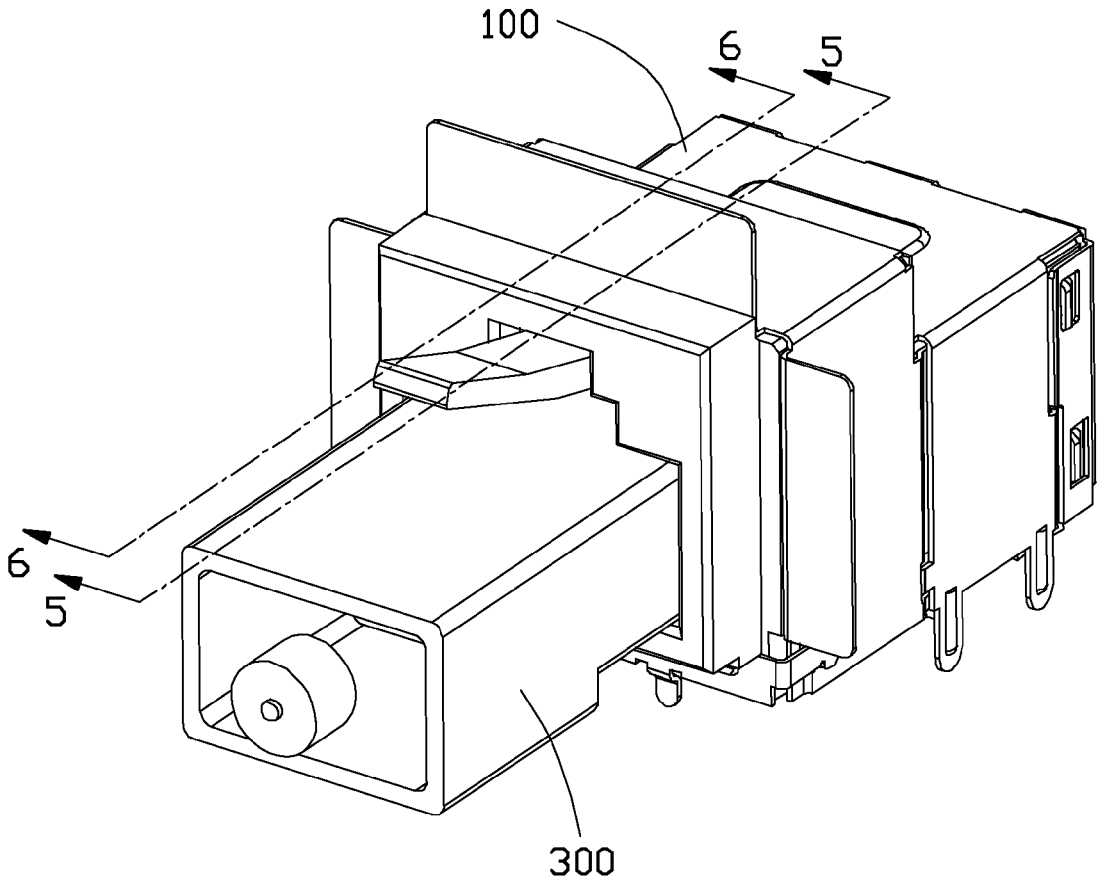
FIG. 1 is a perspective view of an RJ45 socket connector according to the present invention.
Figure 2:
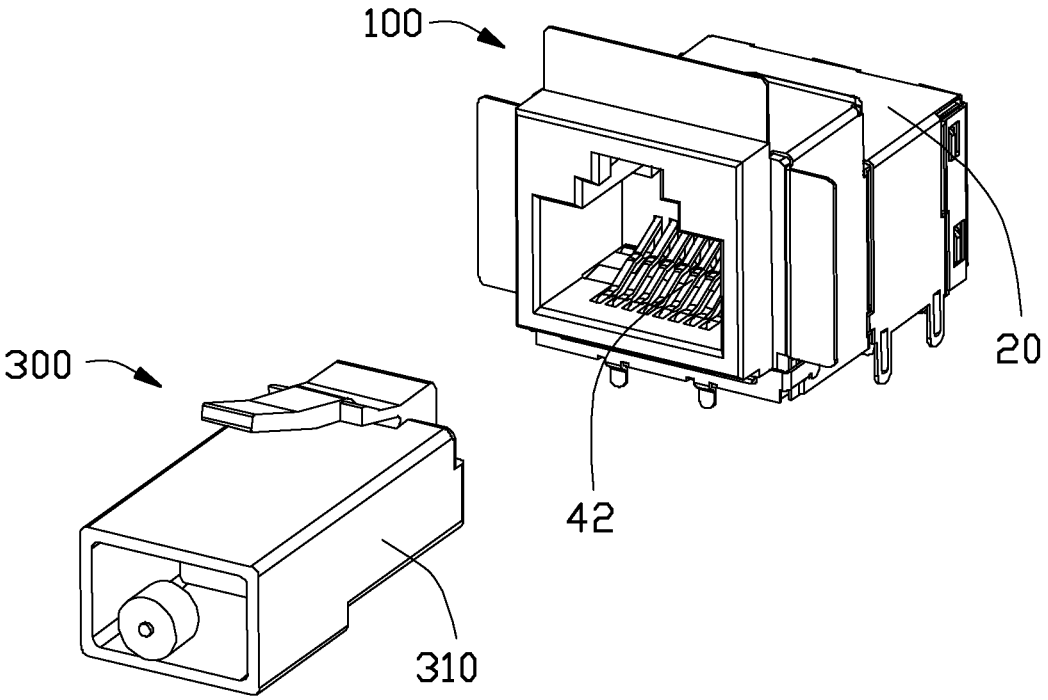
FIG. 2 is a perspective view of the RJ45 socket connector separating with a plug.

Referring to FIGS. 1-2, an RJ45 socket connector 100 can connect with a RJ45 plug 200. Because of a RJ11 plug 300 and the RJ45 plug 200 are similar, the RJ11 plug 300 is mistakenly inserted into the RJ45 socket connector 100 easily. A number of conductive terminals 42 of the RJ45 socket connector 100 happen elastic deformation due to a number of mating terminals of the RJ11 plug 300 mismatching with the conductive terminals 42, the conductive terminals 42 being pressed by an insulative body 310 of the RJ11 plug 300.

Figure 3:
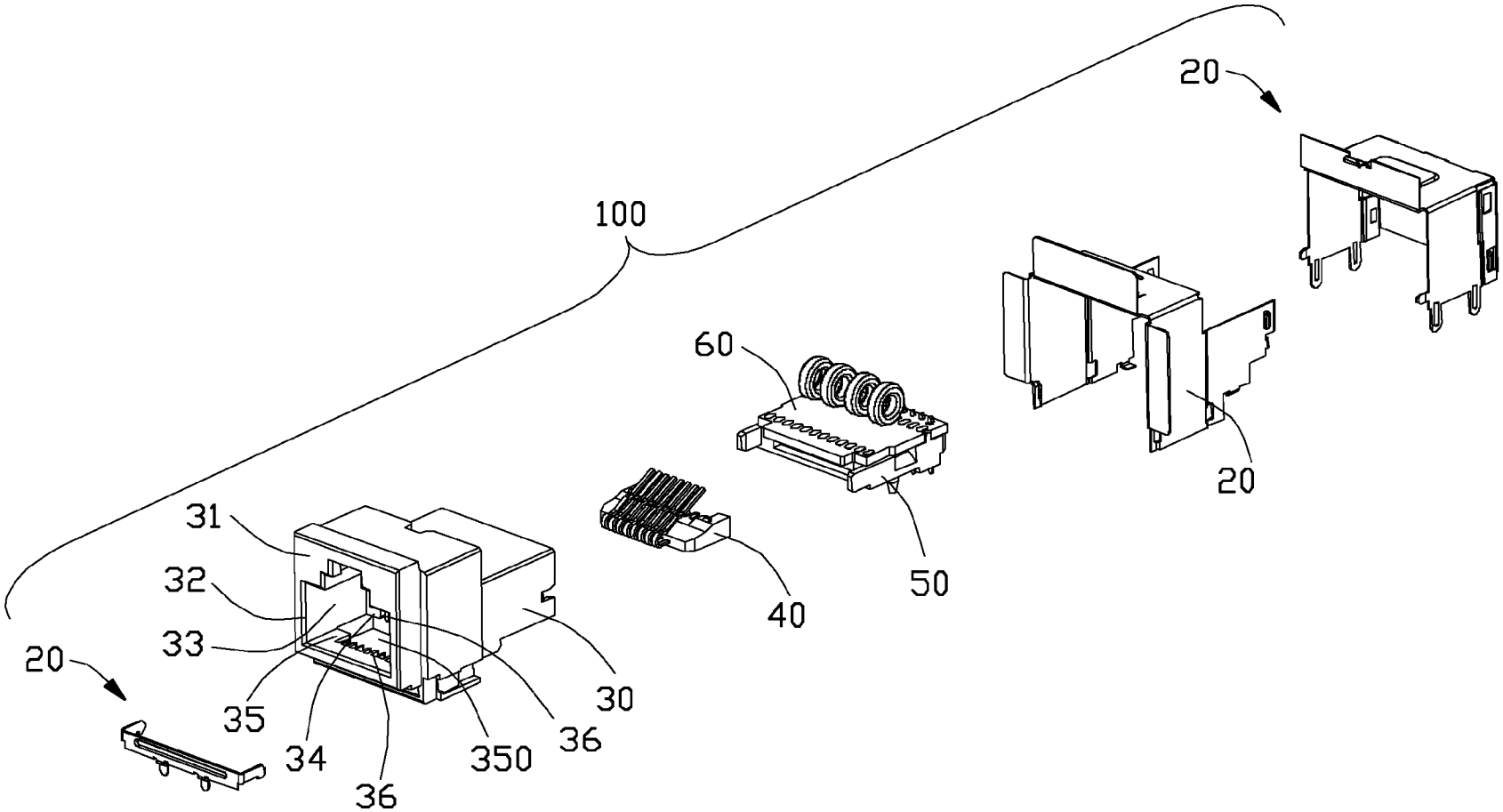
FIG. 3 is an exploded view of the RJ45 socket connector.

Referring to FIG. 3, the RJ45 socket 100 includes a shielding shell 20, an insulative housing 30 received in the shielding shell 20, a terminal module 40 received in the insulative housing 30, a base 50 mounted at rear of the insualtive housing 30 and an inner printed circuit 60 mounted on the base 50. The insulative housing 30 includes a mating face 31, a mating port 32 set in the mating face 31 and a receiving chamber 33 backwardly extending from the mating port 32. The receiving chamber 33 is surrounded by a rear wall 34 of the insulative housing 30 and a bottom wall 35 perpendicular to the rear wall 34. The bottom wall 35 defines a recess 350 for receiving the terminal module 40. A locking recess (not labeled) is formed in the housing 30 adjacent to the receiving chamber 33 for receiving a deflectable latch (not labeled) of the plug. The terminal module 40 includes an insulative carrier 41 and a number conductive terminals or contacts 42 integrally formed in the insulative carrier 41. The insulative carrier 41 defines a number of tubers 410 on a surface of the insulative carrier 41. Each of the tubers 410 has two sides, both of the sides define a slant face 411. When the conductive terminals 42 are pressed down, adjacent conductive terminals 42 may be close to each other. When the adjacent conductive terminals 42 get to the tuber 410, the adjacent conductive terminals 42 separated and slipped downwardly along the slant face 411. Both of the rear wall 34 and the bottom wall 35 of the insulative housing 30 have a number of terminal receiving passageways 36, the terminal receiving passageways 36 extend in a vertical direction in the rear wall 34.

Figure 4:
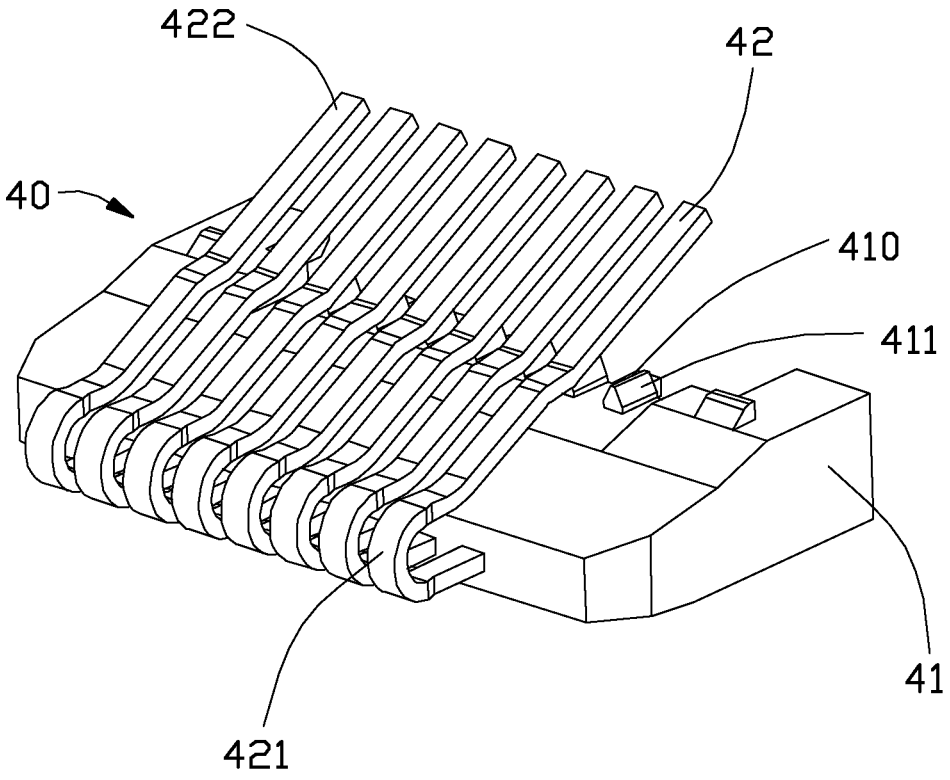
FIG. 4 is a perspective view of a terminal module according to the present invention.
Figure 5:
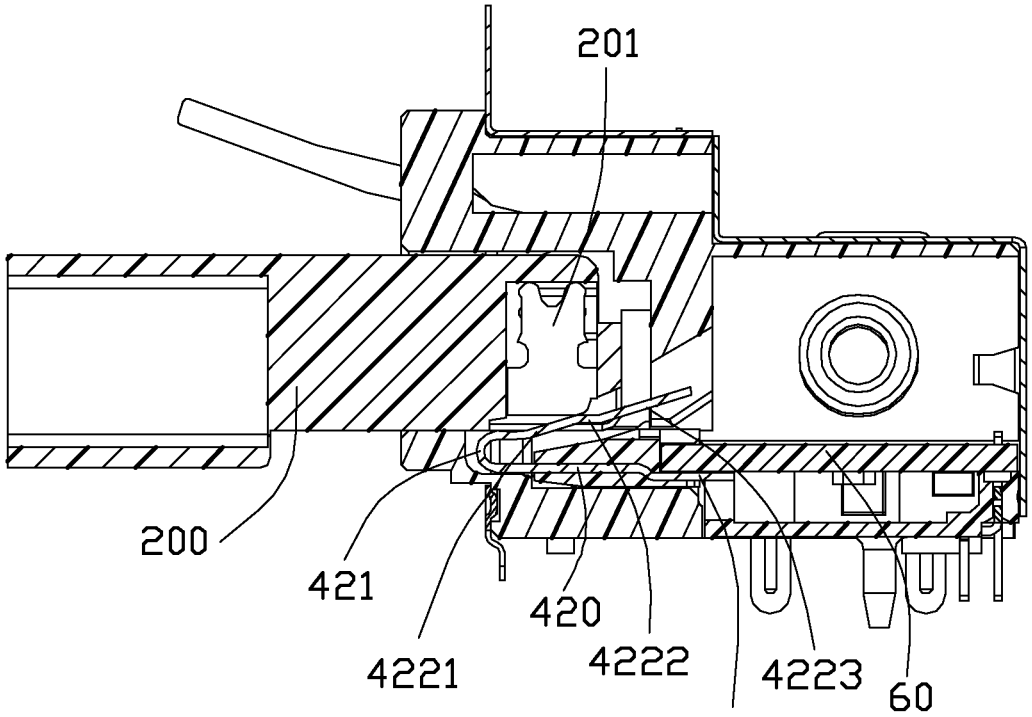
FIG. 5 is a cross-sectional view of an RJ45 plug inserting into the RJ45 socket connector taken along line 5-5 of FIG. 1.

Referring to FIGS. 4-5, the conductive terminal 42 includes a holding portion 420 fixed in the insulative carrier 41, a bending portion 421 forwardly extending from the holding portion 420 beyond the insulative carrier 41 and an elastic contact section 422 backwardly and oblique upwardly extending along a insertion direction from the bending portion 421, and a soldering portion 423 backwardly extending from the bending portion 421 beyond the insulative carrier 41. The soldering portion 423 electrically connects with the inner printed circuit 60. The bending portion 421 is received in terminal receiving passageway 36 in the bottom wall 35 of the insulative housing 30, the end of elastic contact section 422 is received in terminal receiving passageway 36 in the rear wall 34 of the insulative housing 30. When the elastic contact section 422 is pressed, the end of the elastic contact section 422 is moving along up-to-down direction in the corresponding terminal receiving passageway 36 in the rear wall 34. The elastic contact section 422 is received in the receiving chamber 33. The elastic contact section 422 includes a first part 4221 extending tipsily and upwardly, a second part 4222 downwardly and backwardly bending from the first part 4221 and a third part 4223 upwardly extending from the second part 4222.

The first part 4221 is parallel to the third part 4223. When the RJ45 plug 200 is inserted into the RJ45 socket connector 100, a number of mating contacts 201 of the RJ45 plug 200 electrically are connecting with the conductive terminals 42 and resisting on a connecting portion between the first part 4221 and the second part 4222.

Figure 6:
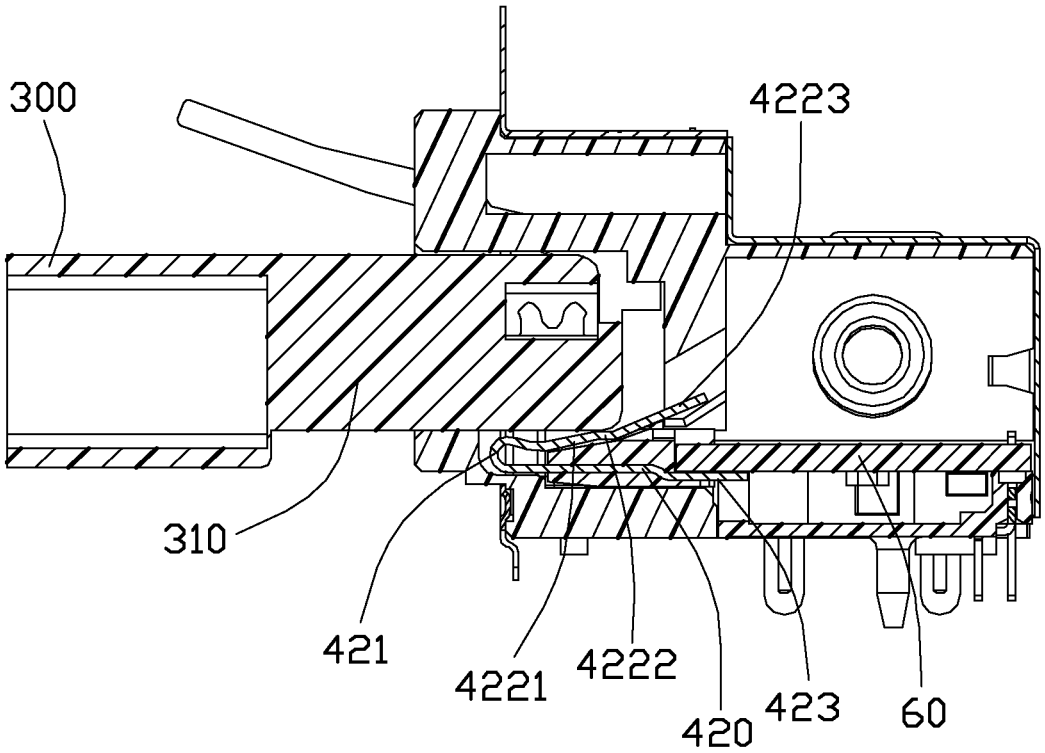
FIG. 6 is a cross-sectional view of an RJ11 plug inserting into the RJ45 socket connector taken along line 6-6 of FIG. 1.

Referring to FIG. 6, when the RJ11 plug 300 is mistake inserted into the RJ45 socket connector 100, the insulative body 310 of the RJ11 plug resists the conductive terminals 42 due to the mating terminals of the RJ11 plug 300 mismatching with the conductive terminals 42. When the RJ11 plug 300 is inserted to the rear wall 34 of the insulative housing 30, a lower surface of the insulative body 310 of the RJ11 plug 300 resists the connecting portion or joint between the first part 4221 and the second part 4222 of the elastic contact section 422 at an apex of the joint. At the same time, the insulative body 310 of the RJ11 plug 300 can not contact with the third part 4223 of the elastic contact section 422. So this structure of the conductive terminal 42 prevents the elastic contact section 422 from over deformation.

From another viewpoint, in the traditional socket, the traditional contact is essentially formed with only one (first) part/segment extending straight without the second part/segment and the third part/segment. On the other hand, during mating, the contact may contact/confront the corresponding terminal of the correct RJ 45 plug wherein the contacting position occurs around the front/bottom corner of the blade type terminal of the correct RJ45 plug and the relatively front contacting region of the contact with the relative small deflection angle of the elastic contact section without over-deflection. Differently, when the incorrect RJ11 plug is mistakenly inserted into the socket, due to different positions of the blade type terminals in the transverse direction compared with the correct RJ45 plug, the contact of the RJ45 socket may contact/confront the front/bottom corner of the housing which is located at a position relatively further inward into the receiving chamber than that of the aforementioned front/bottom corner of the blade terminal of the correct RJ45 plug. The traditional one/single segment contact may be yielded due to over-deflection with the larger deflection angle during insertion of the incorrect RJ11 plug.

Differently, in the instant invention because only the joint between the first part 4221 and the second part 4222 will contact and be depressed by the inserted plug, either the correct RJ45 plug or the incorrect RJ11 plug, and the third part 4223 essentially does not contact or is not depressed by the inserted plug, thus assuring no over-deflection occurs under the incorrect insertion of the RJ11 plug. Notably, in the instant invention, the joint/apex between the first part 4221 and the second part 4222 is essentially the only contacting point of the contact 42 with regard to the corresponding blade type mating contact 201 the RJ45 plug 200 during mating, and such a joint essentially abuts against the corresponding blade type mating contact 201 at a position of the bottom edge proximate the outwardly exposed bottom corner of the blade type contact 201 of the RJ45 plug 200. Notably, in this embodiment the third part 4223 is not pressed by either the correct RJ45 plug 200 or the incorrect RJ11 during mating, thus assuring no over-deflection.

Anyhow, in an alternate embodiment, the third part 4223 may contact the bottom corner of the blade type contact 201 of the correct inserted RJ45 plug 200 even though the joint between the first part 4221 and the second part 4222 may also contact the bottom edge of the blade type contact 201 during mating. The feature of the invention is to have the joint between the first part 4221 and the second part 4222 contact bottom face of the housing of the incorrect RJ11 plug instead of the third part 4223 during a mis-mating with the incorrect RJ11 plug so as to avoid an over-deflection of the whole contact section 422.

Furthermore, in another alternate embodiment, a joint between the second part 4222 and the third part 4223 may optionally contact the insulative carrier during deflection, disregarding in a correct mating or an incorrect mating, so as to convert an operation style of the contact section 422 from the so-called cantilevered beam (i.e., single support point) to the so-called restrained beam (i.e., dual opposite support points) wherein the latter provides a relatively strong upward resistant force against the plug compared with the former. Notably, the third part 4223 is adjacent to a free end of the aforementioned cantilevered contact section 422 while the first part 4221 is adjacent to a root of the aforementioned cantilevered contact section 422.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the members in which the appended claims are expressed.

What is claimed is:

1. An RJ45 socket connector for use with an RJ plug, comprising:

an insulative housing having a receiving chamber; and a plurality of conductive terminals disposed in the insulative housing, the conductive terminal having an elastic contact section oblique upwardly and backwardly extending along an insertion direction; wherein the elastic contact section has a first part extending oblique upwardly, a second part downwardly and backwardly bent from a rear end of the first part, and a third part upwardly extending from a rear end of the second part, said first part, said second part and said third part being configured and dimensioned and characterized with a connecting portion between the first part and the second part which is adapted to contact a mating contact of an inserted RJ45 plug, and the connecting portion being adapted to resist a lower insulative body surface of a mistakenly inserted RJ11 plug; wherein the third part is configured and dimensioned not to contact the RJ45 plug during mating.

2. The RJ45 socket connector as claimed in claim 1, wherein the first part of the elastic contact section is parallel to the third part of the elastic contact section.

3. The RJ45 socket connector as claimed in claim 1, further comprising a terminal module mounted on the insulative housing, the terminal module comprising an insulative carrier defining a plurality of tubers each disposed between two adjacent conductive terminals.

4. The RJ45 socket connector as claimed in claim 3, wherein the tuber has two sides each defining a slant face for preventing two adjacent conductive terminals from contacting after the conductive terminals are pressed.

5. The RJ45 socket connector as claimed in claim 3, wherein the holding portion of the conductive terminal is integrated in the insulative carrier.

6. The RJ45 socket connector as claimed in claim 1, wherein the conductive terminal comprises a holding portion and a bending portion connected with the holding portion and the elastic contact section.

7. The RJ45 socket connector as claimed in claim 6, wherein the insulative housing has a bottom wall, a rear wall perpendicular to the bottom wall, and a plurality of terminal receiving passageways in the bottom wall and the rear wall, the bending portion of the conductive terminal is received in the terminal receiving passageway in the bottom wall, and an end of the elastic contact section of the conductive terminal is received in the terminal receiving passageway in the rear wall.

8. The RJ45 socket connector as claimed in claim 1, wherein the terminals are retained within an insulative carrier associated within the housing, and the contact section intimately confronts the insulative carrier in a vertical direction during mating.

9. An RJ45 modular jack for use with a modular plug, comprising:

an insulative housing defining a receiving chamber forwardly communicating with an exterior in a front-to-back direction, a locking recess formed in the housing adjacent to the receiving chamber for securing a deflectable latch of the modular plug;

a plurality of contacts retained by an insulative carrier associated with the housing, each of said contacts including a bending portion around a front opening of the receiving chamber, and an elastic contact section extending rearward and obliquely from the bending portion in a cantilevered manner and including a first part extending rearward from the bending portion, a second part extending rearwardly from and angled with the first part, and a third part extending rearwardly from and angled with the second part; and a joint located between the first part and the second part and forming thereon an apex which is closer to the locking recess than both of said first part and said second part in a vertical direction perpendicular to said front-to-back direction; wherein said joint is configured, dimension and positioned for contacting a position at a horizontal edge of a corresponding blade type contact of an inserted RJ45 plug during mating while said third part is configured, dimension and positioned for not contacting a front corner of an insulative housing of a mistakenly inserted RJ11 plug during mating so as to avoid over-deflection of the contact section, wherein said front corner is opposite to the deflectable latch of said RJ 11 plug in the vertical direction; wherein the first part is adjacent to a root of the elastic contact section while the third part is adjacent to a free end of the elastic contact section.

10. The RJ45 modular jack as claimed in claim 9, wherein said position is essentially located at a front corner of the blade type contact of the inserted RJ45 plug.

11. The RJ45 modular jack as claimed in claim 9, wherein each of said contacts further includes a holding portion rearwardly extending rearward from the bending portion opposite to the contact section in the vertical direction for holding the contact within the insulative carrier, said insulative carrier has a portion located between the contact section and the holding portion, and said contact section intimately confronts said portion in the vertical direction when the apex of the contact section is pressed by the inserted plug in the vertical direction.

12. The RJ45 modular jack as claimed in claim 11, wherein an apex of another joint between the second part and the third part is closer to said portion than both said second part and said third part in the vertical direction.

13. The RJ45 modular jack as claimed in claim 9, wherein the first part and the third part extend rearwardly and obliquely toward the locking recess in the vertical direction while said second part extends rearwardly and obliquely away from the locking recess in the vertical direction.

14. The RJ45 modular jack as claimed in claim 9, wherein the third part is configured and dimension not to contact a front corner of the corresponding blade type contact of said RJ45 plug during mating.

15. The RJ45 modular jack as claimed in claim 9, wherein said insulative carrier is discrete from but assembled to the housing.

16. The RJ45 modular jack as claimed in claim 9, wherein said locking recess is located above the insulative carrier and the contacts associated therewith.

17. An RJ45 modular jack for use with a modular plug, comprising:

an insulative housing defining a receiving chamber forwardly communicating with an exterior in a front-to-back direction, a locking recess formed in the housing adjacent to the receiving chamber for securing a deflectable latch of the modular plug;

a plurality of contacts retained by an insulative carrier associated with the housing, each of said contacts including a bending portion around a front opening of the receiving chamber, and an elastic contact section extending rearward and obliquely from the bending portion in a cantilevered manner and including a first part extending rearward from the bending portion, a second part extending rearwardly from and angled with the first part, and a third part extending rearwardly from and angled with the second part; and a joint located between the first part and the second part and forming thereon an apex which is closer to the locking recess than both of said first part and said second part in a vertical direction perpendicular to said front-to-back direction; wherein said joint is configured, dimension and positioned for contacting a position at a horizontal edge of a corresponding blade type contact of an inserted RJ45 plug during mating while said third part is configured, dimension and positioned for not contacting any portion of said corresponding blade type contact of the inserted RJ45 plug during mating; wherein the first part is adjacent to a root of the elastic contact section while the third part is adjacent to a free end of the elastic contact section.

18. The RJ45 modular jack as claimed in claim 17, wherein said position is essentially located at a curved corner of the corresponding blade type contact of said inserted RJ45 plug.

19. The RJ45 modular jack as claimed in claim 17, wherein said contact section intimately confronts a portion of said insulative carrier in the vertical direction when the apex of the joint is pressed by the inserted plug in the vertical direction.

20. The RJ45 socket connector as claimed in claim 1, wherein the elastic contact section extends in a cantilevered manner, and the first part is adjacent to a root of the elastic contact section while the third part is adjacent to a free end of the elastic contact section.

* * * * *